US011351789B2

(12) United States Patent
Anderson et al.

(10) Patent No.: US 11,351,789 B2
(45) Date of Patent: Jun. 7, 2022

(54) FLUID EJECTION DEVICE WITH NOZZLE COLUMN DATA GROUPS INCLUDING DRIVE BUBBLE DETECT DATA

(71) Applicant: HEWLETT-PACKARD DEVELOPMENT COMPANY, L.P., Spring, TX (US)

(72) Inventors: Daryl E Anderson, Corvallis, OR (US); Eric Martin, Corvallis, OR (US); James Gardner, Corvallis, OR (US)

(73) Assignee: Hewlett-Packard Development Company, L.P., Spring, TX (US)

( * ) Notice: Subject to any disclaimer, the term of this patent is extended or adjusted under 35 U.S.C. 154(b) by 0 days.

(21) Appl. No.: 16/988,296

(22) Filed: Aug. 7, 2020

(65) Prior Publication Data

US 2020/0369035 A1 Nov. 26, 2020

Related U.S. Application Data

(63) Continuation of application No. 16/335,180, filed as application No. PCT/US2016/058869 on Oct. 26, 2016, now Pat. No. 10,821,735.

(51) Int. Cl.
*B41J 2/175* (2006.01)
*B41J 2/045* (2006.01)
(Continued)

(52) U.S. Cl.
CPC ..... *B41J 2/175* (2013.01); *B41J 2/0451* (2013.01); *B41J 2/0458* (2013.01);
(Continued)

(58) Field of Classification Search
CPC ..... B41J 2/175; B41J 2/0451; B41J 2/04543; B41J 2/0458; B41J 2/14129; B41J 2/14153; B41J 2/16579
See application file for complete search history.

(56) References Cited

U.S. PATENT DOCUMENTS 5,500,657 A 3/1996 Yauchi et al.
6,557,971 B1 5/2003 Vega
(Continued)

FOREIGN PATENT DOCUMENTS

CN 1953870 A 4/2007
CN 101970241 B 8/2013
(Continued)

*Primary Examiner* — Jason S Uhlenhake
(74) *Attorney, Agent, or Firm* — Dicke Billig & Czaja PLLC

(57) ABSTRACT

A fluid ejection device includes a number of primitives, each receiving a same set of addresses and including a number of ejection chambers, each corresponding to a different address of the set of addresses and including a drive bubble formation mechanism and a drive bubble detect (DBD) mechanism. Input logic receives nozzle column data groups (NCG), each NCG including fire pulse groups (FPG), each FPG including DBD data having an enable value or disable value, and ejection data bits, each ejection data bit corresponding to a different one of the primitives. For each FPG of each NCG, activation logic identifies the FPG as a DBD FPG when the DBD data has the enable value and activates in each primitive the drive bubble formation mechanism and the DBD mechanism identified by the DBD FPG to perform a DBD measurement.

20 Claims, 10 Drawing Sheets

(51) Int. Cl.
*B41J 2/14* (2006.01)
*B41J 2/165* (2006.01)

(52) U.S. Cl.
CPC ..... *B41J 2/04543* (2013.01); *B41J 2/14129* (2013.01); *B41J 2/14153* (2013.01); *B41J 2/16579* (2013.01)

(56) References Cited

U.S. PATENT DOCUMENTS

| | | | | |
|---|---|---|---|---|
| 6,648,444 | B2 | 5/2003 | Valero et al. | |
| 2007/0070100 | A1* | 3/2007 | Vladislav | B41J 29/393 347/9 |
| 2013/0278656 | A1 | 10/2013 | Govyadinov | |
| 2013/0293610 | A1 | 11/2013 | Suzuki et al. | |
| 2015/0367631 | A1 | 12/2015 | Portela Mata et al. | |
| 2016/0165334 | A1 | 6/2016 | Grossman | |
| 2017/0050429 | A1 | 2/2017 | Anderson | |
| 2017/0242633 | A1 | 8/2017 | Martin | |
| 2018/0050537 | A1 | 2/2018 | Bakker | |

FOREIGN PATENT DOCUMENTS

| | | | |
|---|---|---|---|
| CN | 102202897 | B | 5/2016 |
| WO | WO-2007063101 | A1 | 6/2007 |
| WO | WO-2015191060 | A1 | 12/2015 |
| WO | WO-2016068898 | A1 | 5/2016 |
| WO | WO-2016089371 | A1 | 6/2016 |
| WO | WO-2016130157 | A1 | 8/2016 |

* cited by examiner

FLUID EJECTION DEVICE WITH NOZZLE COLUMN DATA GROUPS INCLUDING DRIVE BUBBLE DETECT DATA

BACKGROUND

Fluid ejection devices typically include a number of fluid chambers, or firing chambers, having nozzles from which droplets of fluid (such as ink droplets, for example) are selectively ejected via controlled operation of drive bubble formation mechanisms (such as firing resistors, for example). During operation, conditions may arise that adversely affect the ability of ejection chambers and/or nozzles to properly eject fluid. For example, a blockage may occur in the nozzle or ejection chamber, or fluid may become solidified on the drive bubble formation mechanism. To detect such conditions, techniques, such as optical drop detect and drive bubble detect (DBD), for example, have been developed to assess nozzle integrity or health.

DETAILED DESCRIPTION

Figure 1:
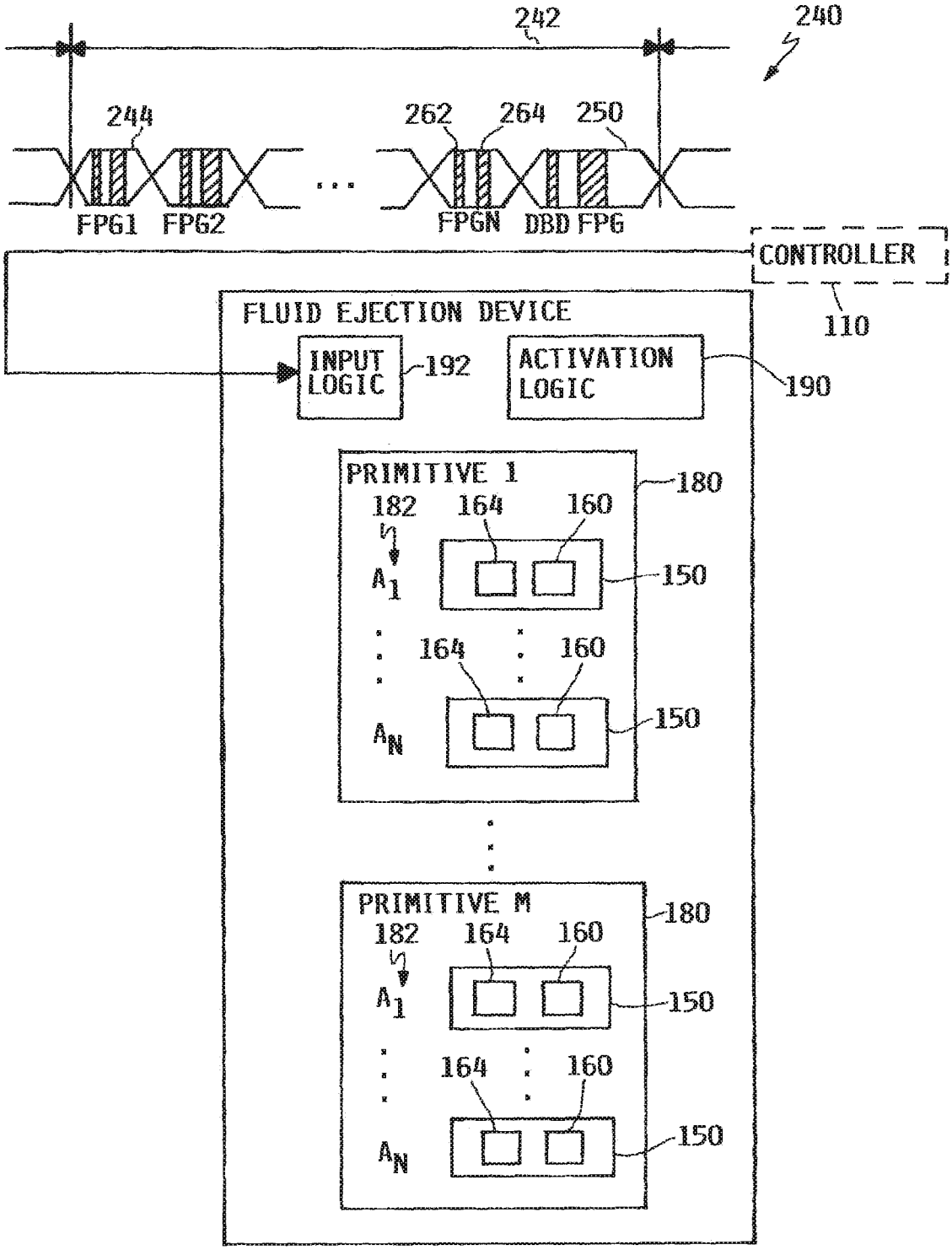
FIG. 1 is a bock and schematic diagram generally illustrating fluid ejection device employing nozzle column data groups with drive bubble detect data, according to one example.

In the following detailed description, reference is made to the accompanying drawings which form a part hereof, and in which is shown by way of illustration specific examples in which the disclosure may be practiced. It is to be understood that other examples may be utilized and structural or logical changes may be made without departing from the scope of the present disclosure. The following detailed description, therefore, is not to be taken in a limiting sense, and the scope of the present disclosure is defined by the appended claims. It is to be understood that features of the various examples described herein may be combined, in part or whole, with each other, unless specifically noted otherwise.

Fluid ejection devices typically include a number of fluid chambers having nozzles from which droplets of fluid are selectively ejected via controlled activation of drive bubble formation mechanisms. Drive bubble formation mechanisms may include thermal drive bubble formation mechanisms, such as resistors, and other types of drive bubble formation mechanisms, such as piezoelectric mechanisms, for examples. Together, a fluid chamber, nozzle, and drive bubble formation mechanism are sometimes referred to as a drop generator. In one example, a fluid ejection device may be implemented as an inkjet printhead for ejecting ink drops, such as onto a print media form a desired printed image.

Typically, the fluid chambers of a fluid ejecting device are arranged into groups of fluid chambers referred to as primitives, with the primitives further being organized in columns, with each primitive receiving a same set of addresses, and each fluid chamber of a primitive corresponding to a different one of the address of the set of addresses. In one example, print data, or more generally ejection data, to control the operation of the drive bubble formation mechanisms to selectively eject fluid droplets from the nozzle of the fluid chamber to form a desired printed image (such as on print medium, for example) is provided to the fluid ejection device in the form of a series of nozzle column data groups (NCGs), or more generally ejection column groups, with each NCG including a series of fire pulse groups (FPGs). In one example, each FPG corresponds to at least one address of the set of addresses and includes a different set of data bits for each address, and with each data bit of each set of data bits corresponding to a different primitive.

During fluid ejection device operation, conditions may arise that adversely affect the ability of ejection chambers and/or nozzles to properly eject fluid. For example, a blockage may occur in the nozzle or ejection chamber, or fluid, or components of the fluid, may become solidified on the drive bubble formation mechanism. To detect such conditions, techniques, such as optical drop detect and drive bubble detect (DBD), have been developed to assess the integrity or "health" of the nozzle, ejection chamber, and drive bubble formation mechanism. However, such techniques, including DBD, occur between print pages or print jobs which causes delays and reduces printer throughput.

FIG. 1 is a block and schematic diagram generally illustrating a fluid ejection device 114 with nozzle column data groups 242 including both ejection data 264 and data for performing DBD operations 262 for ejection chambers 150 of fluid ejection device 114, according to one example of the present disclosure. In one example, fluid ejection device 114 includes a plurality of primitives 180, illustrated as primitives P1 to PM, with each primitive 180 having a same set of addresses 182, illustrated as addresses A1 to AN, and each primitive 180 having a plurality of ejection chambers 150. Each ejection chamber 150 corresponds to a different one of the addresses, A1 to AN, of the set of addresses 182 and includes a drive bubble formation mechanism 160 and a DBD sensor mechanism 164.

Input logic 192 receives a number or series 240 of nozzle column data groups (NCGs) 242 (e.g., from a controller 110), with each NCG 242 including a series of fire pulse groups (FPG) 244, with each FPG 244 including a DBD data 262 having an enable value or a disable value, and ejection data bits 264, each ejection data bit corresponding to a different one of the primitives 180 (see FIGS. 6 and 7 below, for example).

Fluid ejection device 114 further includes activation logic 190. In one example, for each FPG 244 of each NCG 242 of the series of NCGs 240, activation logic 190 identifies the FPG 244 as a DBD FPG 250 when the DBD data 262 has the enable value, where the DBD FPG 250 corresponds to at least one address of the set of addresses 182. When a DBD FPG 250 is identified, activations logic 190 activates, in each primitive, the drive bubble formation mechanism 160 of the ejection chamber 150 having the same address as the at least one address to which the DBD FPG 250 corresponds to form a drive bubble and to perform DBD sensing measurement if the corresponding ejection data bit 264 is set (see FIG. 3B below, for example).

As will be described in greater detail below, including DBD operations data in the form of FPGs in NCGs, in accordance with the present disclosure, enables DBD operations to be performed during ejection operations without reducing throughput of fluid ejection device 114. For example, when fluid ejection device 114 is implemented as an inkjet printhead 114, for instance, including data for performing DBD operations in the form of DBD FPGs 250 along with ejection data in the form of FPGs 244 enables DBD operations to be performed on ejection chambers 150 without reducing a number of pages printed by inkjet printhead 114. Furthermore, in an instance where fluid ejection device 114 is implemented as an inkjet printhead 114, even though ink drops will be ejected onto print media as part of performing a DBD operation, a print artifact resulting from such ink drop will be imperceptible to person viewing such image.

Figure 2:
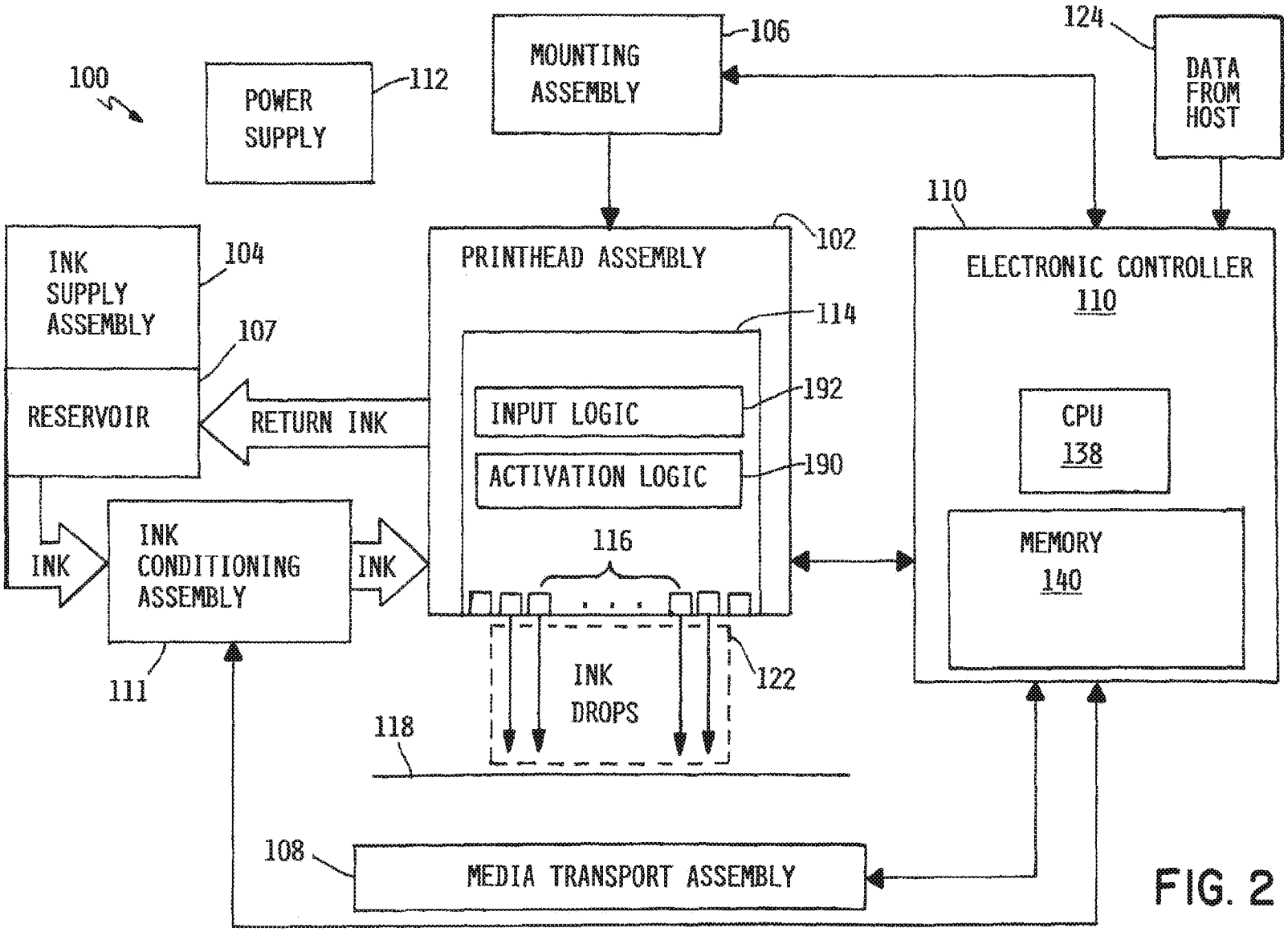
FIG. 2 is a block and schematic diagram illustrating a fluid ejection system including a fluid ejection device employing nozzle column data groups with drive bubble detect data, according to one example.

FIG. 2 is a block and schematic diagram illustrating generally a fluid ejection system 100 including a fluid ejection device, such as a fluid ejection assembly 102, including a number fluid chambers and employing NCGs (more generally, ejection column groups) which, in accordance with the present disclosure, include both ejection data and DBD data for directing DBD measurements of selected fluid chambers of fluid ejecting device 102. In addition to fluid ejection assembly 102, fluid ejecting system 100 includes a fluid supply assembly 104 including an fluid storage reservoir 107, a mounting assembly 106, a media transport assembly 108, an electronic controller 110, and at least one power supply 112 that provides power to the various electrical components of fluid ejecting system 100.

Fluid ejecting assembly 102 includes, in accordance with the present disclosure, activation logic 190 and input logic 192, such as described above, and includes at least one fluid ejection device 114 that ejects drops of fluid through a plurality of orifices or nozzles 116, such as onto print media 118. According to one example, as illustrated, fluid ejection device 114 may be implemented as an inkjet printhead 114 ejecting drops of ink onto print media 118. Fluid ejection device 114 includes nozzles 116, which are typically arranged in one or more columns or arrays, with groups of nozzles being organized to form primitives, and primitives arranged into primitive groups. Properly sequenced ejections of fluid drops from nozzles 116 result in characters, symbols or other graphics or images being printed on print media 118 as fluid ejecting assembly 102 and print media 118 are moved relative to one another.

Although broadly described herein with regard to a fluid ejection system 100 employing a fluid ejection device 114, fluid ejection system 100 may be implement as an inkjet printing system 100 employing an inkjet printhead 114, where inkjet printing system 100 may be implemented as a drop-on-demand thermal inkjet printing system with inkjet printhead 114 being a thermal inkjet (TIJ) printhead 114. Additionally, the inclusion of DBD operations data in PCGs, according to the present disclosure, can be implemented in other printhead types as well, such wide array of TIJ printheads 114 and piezoelectric type printheads, for example. Furthermore, the inclusion of DBD operations data in PCGs, in accordance with the present disclosure, is not limited to inkjet printing devices, but may be applied to any digital fluid dispensing device, including 2D and 3D printheads, for example.

Referencing FIG. 2, in operation, fluid typically flows from reservoir 107 to fluid ejection assembly 102, with fluid supply assembly 104 and fluid ejection assembly 102 forming either a one-way fluid delivery system or a recirculating fluid delivery system. In a one-way fluid delivery system, all of the supplied to fluid ejection assembly 102 is consumed during printing. However, in a recirculating fluid delivery system, only a portion of the fluid supplied to fluid ejection assembly 102 is consumed during printing, with fluid not consumed during printing being returned to supply assembly 104. Reservoir 107 may be removed, replaced, and/or refilled.

In one example, fluid supply assembly 104 supplies fluid under positive pressure through an fluid conditioning assembly 11 to fluid ejection assembly 102 via an interface connection, such as a supply tube. Fluid supply assembly includes, for example, a reservoir, pumps, and pressure regulators. Conditioning in the fluid conditioning assembly may include filtering, pre-heating, pressure surge absorption, and degassing, for example. Fluid is drawn under negative pressure from fluid ejection assembly 102 to the fluid supply assembly 104. The pressure difference between an inlet and an outlet to fluid ejection assembly 102 is selected to achieve correct backpressure at nozzles 116.

Mounting assembly 106 positions fluid ejection assembly 102 relative to media transport assembly 108, and media transport assembly 108 positions print media 118 relative to fluid ejection assembly 102, so that a print zone 122 is defined adjacent to nozzles 116 in an area between fluid ejection assembly 102 and print media 118. In one example, fluid ejection assembly 102 is scanning type fluid ejection assembly. According to such example, mounting assembly 106 includes a carriage for moving fluid ejection assembly 102 relative to media transport assembly 108 to scan fluid ejection device 114 across printer media 118. In another example, fluid ejection assembly 102 is a non-scanning type fluid ejection assembly. According to such example, mounting assembly 106 maintains fluid ejection assembly 102 at a fixed position relative to media transport assembly 108, with media transport assembly 108 positioning print media 118 relative to fluid ejection assembly 102.

Electronic controller 110 includes a processor (CPU) 138, a memory 140, firmware, software, and other electronics for communicating with and controlling fluid ejection assembly 102, mounting assembly 106, and media transport assembly 108. Memory 140 can include volatile (e.g. RAM) and nonvolatile (e.g. ROM, hard disk, floppy disk, CD-ROM, etc.) memory components including computer/processor readable media that provide for storage of computer/processor executable coded instructions, data structures, program modules, and other data for fluid ejection system 100.

Electronic controller 110 receives data 124 from a host system, such as a computer, and temporarily stores data 124 in a memory. Typically, data 124 is sent to fluid ejection system 100 along an electronic, infrared, optical, or other information transfer path. In one example, when fluid ejection system 100 is implemented as an inkjet printing system 100, data 124 represents a file to be printed, such as a document, for instance, where data 124 forms a print job for inkjet printing system 100 and includes one or more print job commands and/or command parameters.

In one implementation, electronic controller 110 controls fluid ejection assembly 102 for ejection of fluid drops from nozzles 116 of fluid ejection device 114. Electronic controller 110 defines a pattern of ejected fluid drops to be ejected from nozzles 116 and which, together, in the case of being implemented as an inkjet printhead, form characters, symbols, and/or other graphics or images on print media 118 based on the print job commands and/or command parameters from data 124. In one example of the present disclosure, as will be described in greater detail below, electronic controller 110 provides ejection data in the form NCGs to fluid ejection assembly 102 which result in nozzles 114 ejecting the defined pattern of fluid drops. According to one example, as will be described in greater detail below, the NCGs include ejection data in the form of FPGs and DBD operations data in the form of DBD FPGs. In one example, the NCGs may be received by electronic controller 110 as data 124 from a host device (e.g., a print driver on a computer).

Figure 3A:
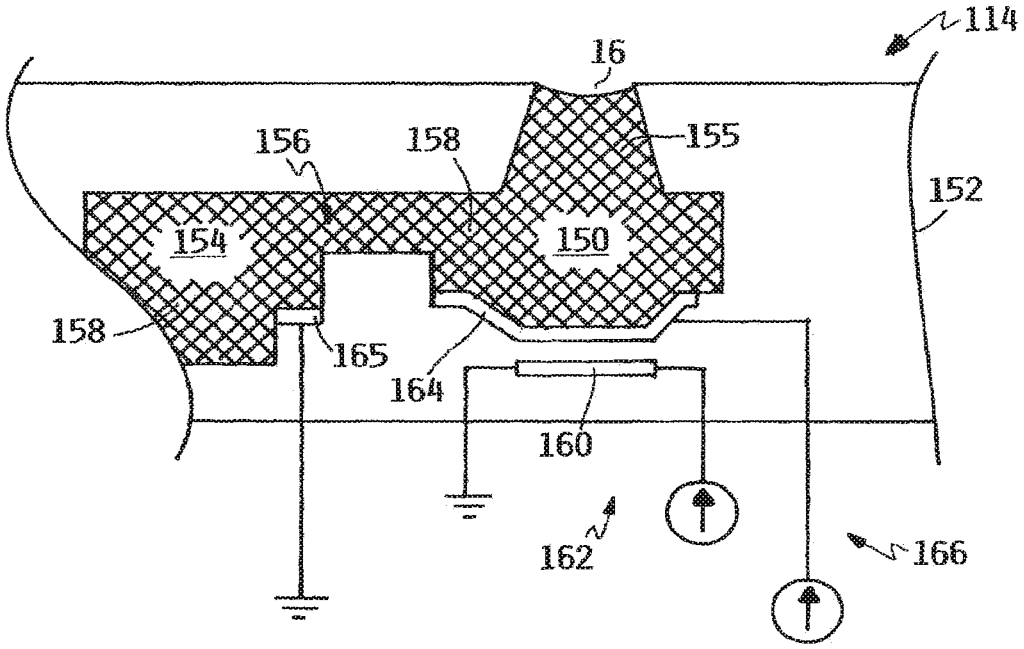
FIG. 3A is a schematic diagram generally illustrating an ejection chamber, according to one example.
Figure 3B:
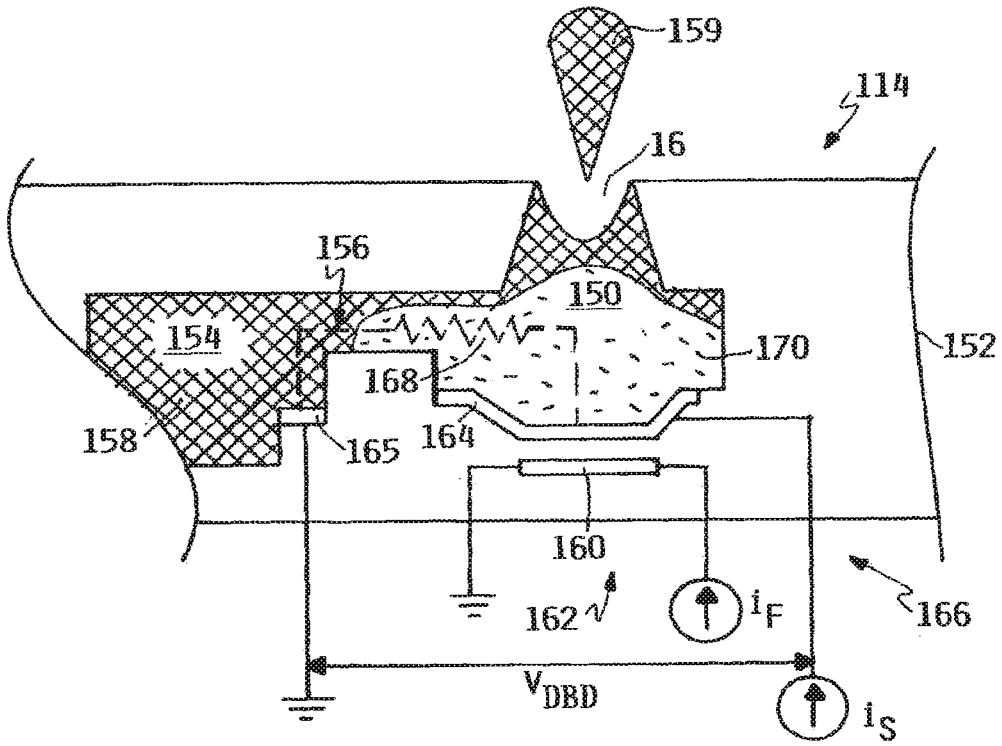
FIG. 3B is a schematic diagram generally illustrating an ejection chamber, according to one example.

FIGS. 3A and 3B are block and schematic diagrams generally showing a cross-sectional view of a portion of fluid ejection device 114 and illustrating an example of an ejection chamber 150. Ejection chamber 150 is formed in a substrate 152 of fluid ejection device 114 and is in liquid communication with a fluid feed slot 154 via a fluid feed channel 156 which communicates fluid 158 from fluid feed slot 154 to ejection chamber 150. A nozzle 16 extends through substrate 152 to vaporization chamber 150.

According to one example, ejection chamber 150 includes a drive bubble formation mechanism 160 disposed there below in substrate 152, such as a firing resistor 160 or other type of fluid ejector, for example. Firing resistor 160 is electrically coupled to ejection control circuitry 162 which controls the application of an electrical current to firing resistor 162 to form drive bubbles within fluid chamber 158 to eject fluid drops from nozzle 16 according to a defined drop pattern for forming an image on print media 118 (see FIG. 2).

In one example, ejection chamber 150 includes a metal plate 164 (e.g. a tantalum (Ta) plate) which is disposed above firing resistor 160 and in contact with fluid (e.g., ink) within ejection chamber 150, and which protects underlying firing resistor 160 from cavitation forces resulting from the generation and collapse of drive bubbles within ejection chamber 150. In one example, metal plate 164 serves as a DBD sense plate 164 which is electrically coupled to DBD sense circuitry 166, including a ground point 165, for detecting the presence of a drive bubble within ejection chamber 150, as described in greater detail below.

With reference to FIG. 3B, during printing operations (and more generally during fluid ejection operations), ejection control circuitry 162 provides a firing current $i_F$ to firing resistor 160, which evaporates at least one component (e.g., water) of fluid 158 to form a gaseous drive bubble 170 in ejection chamber 150. As gaseous drive bubble 170 increases in size, pressure increases in ejection chamber 158 until a capillary restraining force retaining fluid within ejection chamber 158 is overcome and a fluid droplet 159 is ejected from nozzle 16. Upon ejection of fluid droplet 159, drive bubble 170 collapses, heating of firing resistor 160 is ceased, and fluid 158 flows from slot 154 to refill ejection chamber 158.

As described above, conditions may arise that adversely affect the ability of ejection chamber 150 and nozzle 16 to properly form and/or eject fluid droplets 159. For example, blockages (either partial or complete) may occur in nozzle 16 and/or ejection chamber 158, or fluid make become solidified on surfaces of fluid chamber 158. Such conditions may result in an improperly firing nozzle such as a nozzle that fails to fire (i.e., ejects no fluid droplet), fires early, fires late, releases too much fluid, releases too little fluid, or combinations thereof.

DBD is one technique for monitoring the formation and ejection of drive bubbles 170 within ejection chamber 150 in order to assess the integrity or health of ejection chamber 150, fluid channel 156, nozzle 16, and other components, such as firing resistor 160, for example. According to one example, to perform a DBD operation, ejection control circuitry 162 provides a firing current $i_F$ to firing resistor 160 which begins heating fluid 158 within ejection chamber 150 and begins evaporate at least one component of fluid 155 (e.g., water) to form a drive bubble.

During generation of the drive bubble, DBD sense circuitry 166 provides a fixed sense current is to DBD sense plate 164, with the current flowing through an impedance path 168 formed by the liquid fluid 158 and/or the gaseous material of drive bubble 170 to ground point 165 resulting in generation of a chamber voltage $V_{DBD}$ which is indicative of the characteristics of drive bubble 170 which, in-turn, is indicative of the health of ejection chamber 150 and the associated components. As drive bubble 170 expands, more of DBD sense plate 160 comes into contact with drive bubble 170 and the portions of impedance path 168 formed by fluid 158 and drive bubble 170 changes which results in changes in the impedance of impedance path 168 and, in-turn, in changes in the level of chamber voltage $V_{DBD}$.

In one example, chamber voltage $V_{DBD}$ is continuously monitored, such as by controller 110 (or by logic on fluid ejection device 114, or some combination thereof), during formation and collapse of drive bubble 170 (at ejection of fluid droplet 159 from nozzle 16) and for a time period thereafter, and compared to known voltage profiles of chamber voltages $V_{DBD}$ which are indicative of various conditions of nozzle 16 (e.g., healthy nozzle, partially blocked nozzle, fully blocked nozzle) in order to assess the health of the nozzle. In one example, chamber voltage $V_{DBD}$ is measured at one or more selected points during the formation and collapse of drive bubble 170 and a time period thereafter, with the one or more selected points being compared to the known voltage profiles of healthy nozzles. If it is determined that a nozzle is misfiring, the controller, such as controller 110, may implement servicing procedures or remove the nozzle from service and compensate by adjusting firing patterns of remaining nozzles, for instance.

Figure 4:
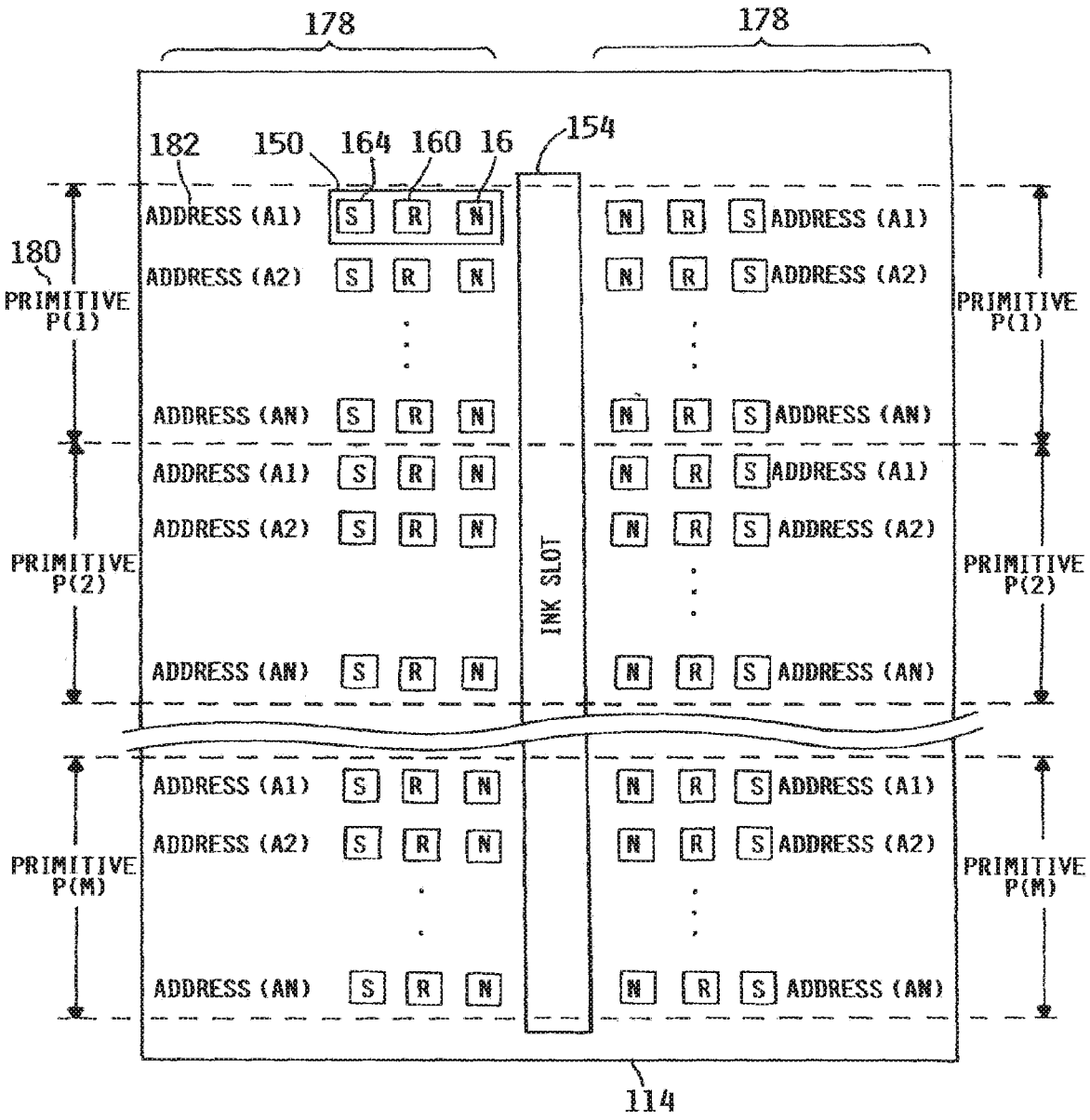
FIG. 4 is a block and schematic diagram illustrating generally a fluid ejection device having ejection chambers organized in primitives, according to one example.

FIG. 4 is a block and schematic diagram generally illustrating a fluid ejection device 114, according to one example, and which can be configured for use with NCGs including DBD operations data, in accordance with the present disclosure. Fluid ejection device 114 includes a number of ejection chambers 150, each including a nozzle 16, a firing resistor 162, and a DBD sense plate 164, with the ejection chambers being arranged in nozzle column groups 178 on each side of an fluid slot 154 (see FIG. 3), with ejection chambers 150 grouped into a number of primitives 180.

In the example of FIG. 4, ejection chambers 150 are organized into primitives 180, with a first group of M primitives, illustrated as primitives P(1) through P(M), arranged to form a nozzle column group 178 on the left-side of fluid slot 154, and a second group of M primitives P(1) through P(M) disposed in a nozzle column group 178 on the right-side of fluid slot 154. In the example of FIG. 4, each primitive 180 includes "N" ejection chambers 150, where N is an integer value (e.g. N=8). Each primitive 180 employs a same set of N addresses 182, illustrated as addresses (A1) to (AN), with each ejection chamber 150, along with its nozzle 16, firing resistor 162, and DBD sense plate 164, corresponding to a different address of the set of addresses 182 so that, as described below, each ejection chamber 150 can be separately controlled within a primitive 180. While illustrated as being arranged in columns along fluid slots, nozzles 16 and primitives 180 may be arranged in other configurations such as in an array where the fluid slot 154 is replaced with an array of fluid feed holes, for instance.

Although illustrated as each having the same number N ejection chambers 150, it is noted that the number of ejection chambers 150 can vary from primitive to primitive. Additionally, although illustrated as having only a single fluid slot 154 with nozzle column groups 178 disposed on each side thereof, it is noted that fluid ejection devices, such as fluid ejection device 114, may employ more than one fluid slot and more than two nozzle column groups.

FIGS. 5-8 below are block and schematic diagrams generally illustrating portions of primitive drive and logic circuitry 190 of fluid ejection device 114, and nozzle column data groups 242 with embedded DBD Fire Pulse Groups 250 which enable printing system 100 and fluid ejection device 114 to perform DBD operations during printing and servicing operations, according to examples of the present disclosure. As described below, primitive drive and logic circuitry 190 serves as activation logic for activating drive bubble formation mechanism 160 (e.g., firing resistors 160) and drive bubble sensor mechanism 164 (e.g., DBD plate 164) to perform a DBD operation in accordance with DBD FPG 250.

Figure 5:
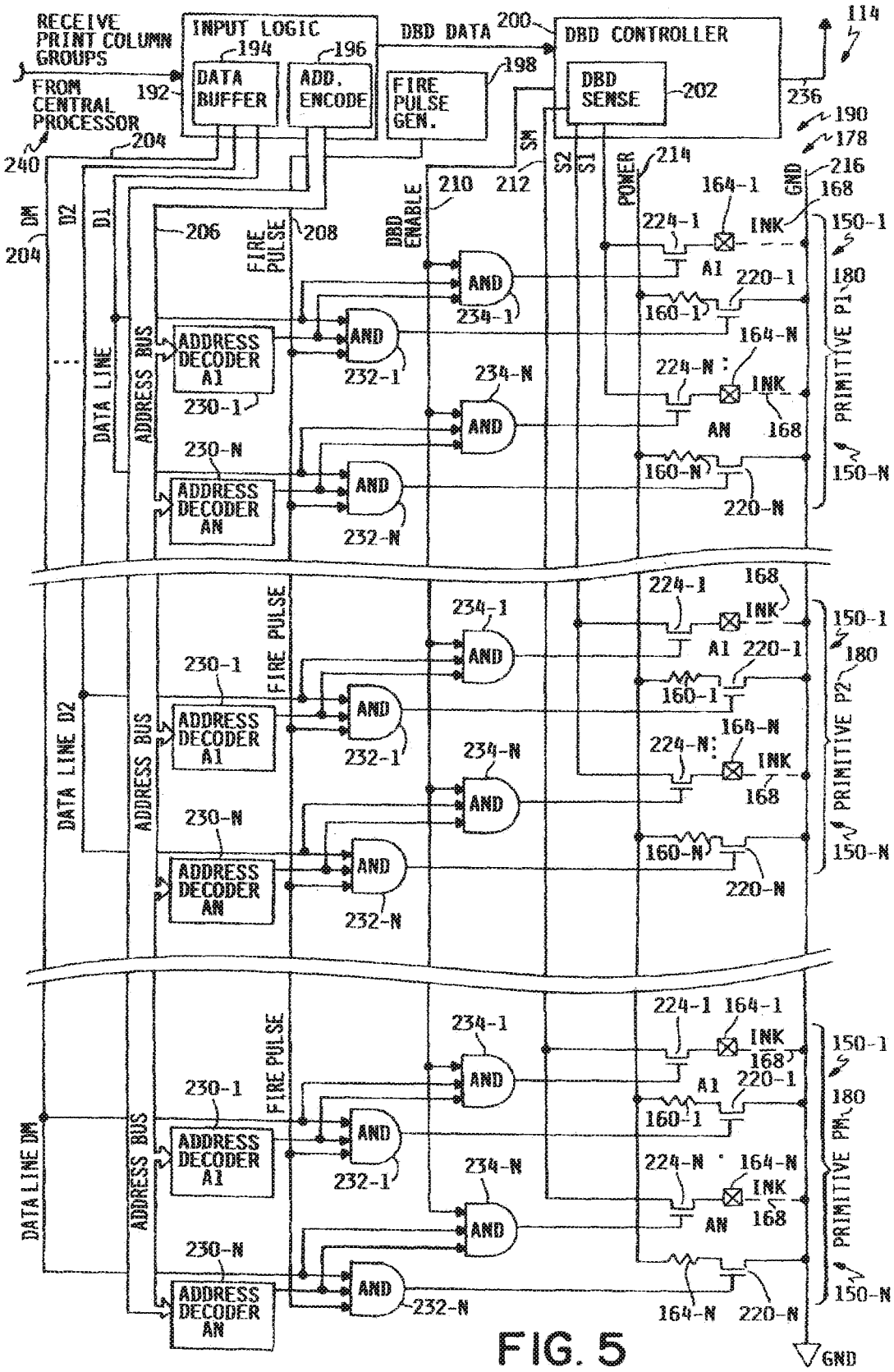
FIG. 5 is a block and schematic diagram illustrating generally an example of portions of primitive drive and control logic circuitry of a fluid ejection device employing print data packets with embedded address data, according to one example.

With reference to FIG. 5, primitive drive and logic circuitry 190 is described with respect to a single nozzle column group, in this case, nozzle column group 178 on the left-hand side of fluid slot 154 having primitives P2 to PM, with each primitive having N ejection chambers 150, as generally illustrated above by FIG. 4. According to the example of FIG. 5, primitive drive and logic circuit 190 includes input logic 192, including a data buffer 194 and an address encoder 196, a fire pulse generator 198, and a DBD controller 200 including DBD sense circuitry 202.

Data buffer 194 is coupled to a set of M data lines 204, illustrated as data lines D1 to DM, with one data line corresponding to each primitive 180, and address encoder 196 is coupled to an address bus 206. Fire pulse generator 198 generates a fire pulse on a fire pulse line 208. DBD controller 200 is in communication with a DBD enable line 210, and DBD sense circuitry 202 is coupled to a set of M DBD sense lines 212, illustrated as DBD sense lines S1 to SM, with one sense line corresponding to teach primitive 180. Primitive drive and logic circuitry 190 further includes a primitive power line 214 and a ground line 216.

Each ejection chamber 150 of each primitive 180 includes a firing resistor 160 (illustrated as firing resistors 160-1 to 160-N) and a DBD sense plate 164 (illustrated as DBD sense plates 164-1 to 164-N). Each firing resistor 160 is coupled between primitive power line 214 and ground line 216 via an activation device, such as a controllable switch 220 (e.g., a field effect transistor (FET)), illustrated as FETs 220-1 to 220-N for each primitive 180. Each DBD sense plate is coupled to ground line 216 via fluid in the corresponding ejection chamber (illustrated as a dashed line), and is coupled to the DDB sense line 212 corresponding to the particular primitive 180 via a controllable switch 224, illustrated as FETs 224-1 to 224-N for each primitive 180.

Each ejection chamber 150 of a primitive 180 has a corresponding address decoder 230 (illustrated as address decoders 230-1 to 230-N) coupled to address bus 206 to decode the address corresponding to the ejection chamber (i.e. one of the addresses A1 to AN in this example). For each ejection chamber 150 of each primitive 180, an AND-gate 232 (illustrated as AND-gates 232-1 to 232-N) has inputs coupled to the output of the corresponding address decoder 230, to the corresponding data line 204, and to fire pulse line 208, and an output coupled to the control gate of the corresponding switch 220 for controlling the associated firing resistor 160. Also for each ejection chamber 150 of each primitive 180, an AND-gate 234 (illustrated as AND-gates 234-1 to 234-N) has inputs coupled to the output of the corresponding address decoder 230, to the corresponding data line 204, and to DBD enable line 210, and an output coupled to the control gate of the corresponding switch 224 for controlling the DBD sense plate 164.

In operation, fluid ejection device 114 receives nozzle ejection data in the form of a series of nozzle column data groups (NCGs), such as from electronic controller 110 (see FIG. 2, for example). FIG. 6 illustrates generally a series 240 of NCGs 242, in accordance with one example of the present disclosure, with each NCG 242 including a series of nozzle fire pulse groups (FPGs) 244, or simply FPGs 244. In one example, as described in greater detail below, one or more FPGs 244 of one or more NCGs 242 of the series 242 may be a DBD FPG 250.

Figure 7:
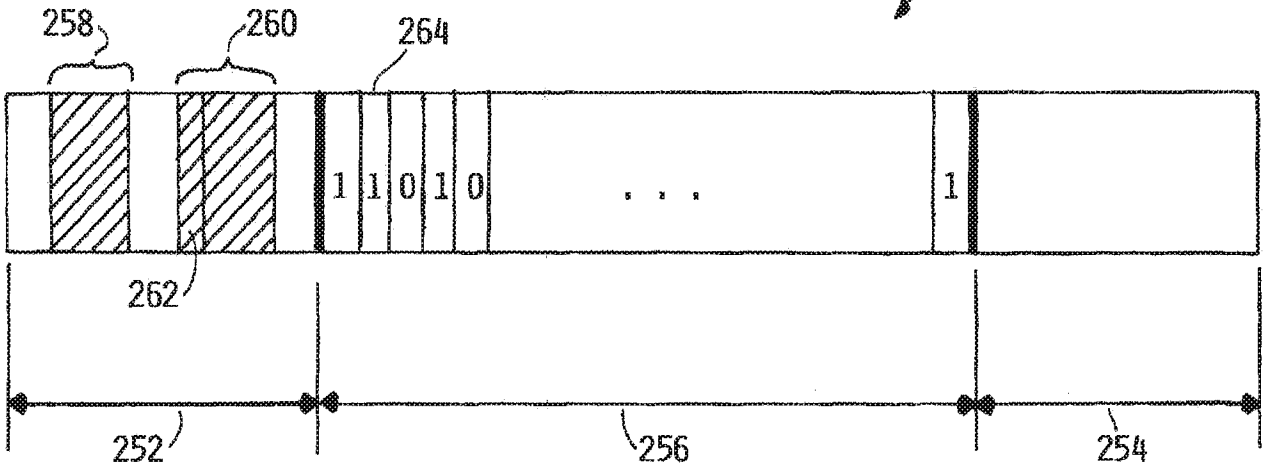
FIG. 7 is block diagram generally illustrating an example of a fire pulse group, according to one example.

FIG. 7 is a block diagram generally illustrating an example of an FPG 244 in accordance with the present disclosure. As illustrated, FPG 244 includes a header portion 252, a footer portion 254, and an ejection data portion 256. According to one example, header portion 252 includes address data 258 indicative of the ejection chamber address to which FPG 244 corresponds. In one example, in accordance with the present disclosure, header portion 252 includes DBD operations data 260, including one or more DBD enable bits 262 having an enable value or a disable value. According to one example, when DBD enable bits 262 have a disable value, the FPG 244 is not a DBD FPG 250. Conversely, when DBD enable bits 262 have an enable value, the FPG is a DBD FPG 250. In one example, in addition to DBD enable bits 262, DBD operations data 260 includes DBD parameters such as measurement delay settings (e.g., when during formation of drive bubble 170 are voltage measurement(s) taken), threshold settings for comparators, and sense current and/or voltage levels, for example.

In addition to address bits 258 and DBD operations data 260, header portion 252 includes other information such a start and sync information, for example. Header portion 254 includes stop bits, among other data.

Ejection data portion 256 includes a series of data bits 264, each data bit corresponding the address defined by address bits 258 and to a different one of the primitives 180 of a group of primitives forming a nozzle column group, such as nozzle column group 178 on the left-hand side of fluid slot 154 in FIG. 4. As will be described below, when DBD enable bits 262 have a disable value, the FGP is not a DBD FPG such that data bits 264 represent print data bits which are combined with the address and fire pulse to control firing of the corresponding firing resistor 160. When DBD enable bits 262 have an enable value, the FPG is a DBD FPG 250 such that the data bits 264 represent DBD ejection data and are combined with the address, fire pulse, and DBD enable data to control firing resistor 160 and activation of the corresponding DBD sense plate 164.

Returning to FIG. 6, according to one example, as illustrated, each NCG 242 includes a series of N FGPs 244, with one FPG corresponding to each of the N addresses in a primitive (e.g., see FIG. 5), and the one or more DBD FPGs 250, in this case a single DBD FPG 250, representing FPGs in addition to the N FPGs 244.

In one example, each FPG 244 has a duration, with FPGs 244 each having a duration $t_1$ and DBD FPG 250 having a duration $t_2$, where the durations $t_1$ of each FPG 244 and the duration $t_2$ of DBD FPG 250 together represent a duration $t_{NCG}$ of NCG 242, where each NCG 242 of the series 242 has a same duration. In one example, the duration t1 and duration t2 are equal. In one example, duration t1 and duration t2 are different. For example, as illustrated, duration t2 may be longer than duration t1.

Figure 8A:
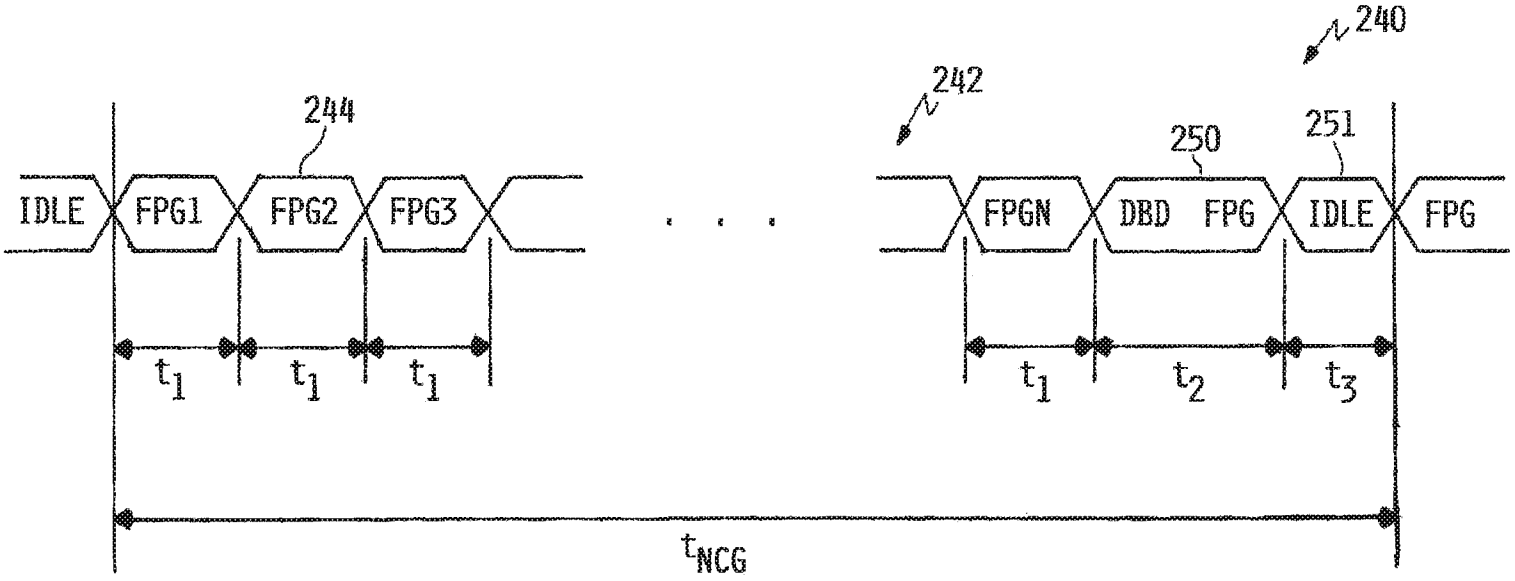
FIG. 8A is block diagram generally illustrating an example of a nozzle column data group, according to one example.
Figure 8B:
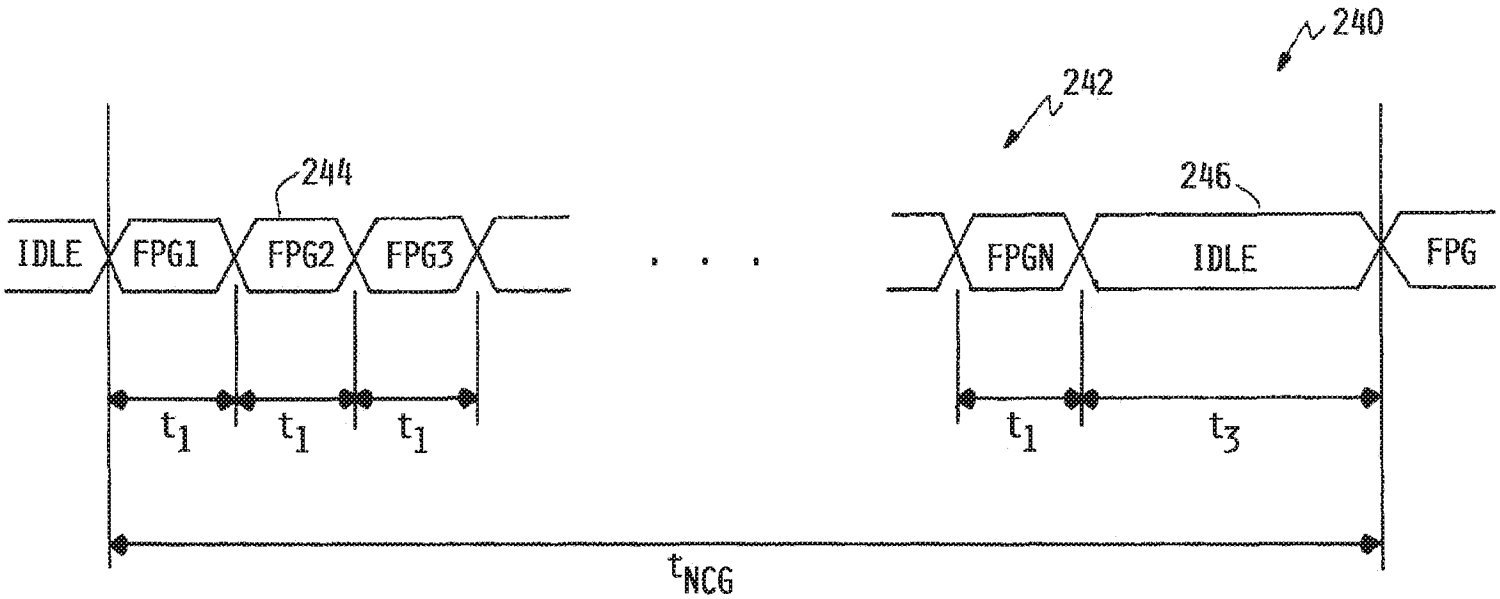
FIG. 8B is block diagram generally illustrating an example of a nozzle column data group, according to one example.

FIGS. 8A and 8B are block diagrams generally illustrate other examples of NCGs 242. FIG. 8A illustrates an example where, in addition to including a DBD FPG 250, NCG 252 further includes an idle time 251 having a duration $t_3$. In one example, idle time 251 is included in NCG 252 to maintain timing synchronization with the operation of other components of printing system 100 (e.g., registration of media 118 by media transport assembly, see FIG. 3) which may vary depending on particular implements or configurations. FIG. 8B illustrates an example where NCG 242 does not include a DBD FPG 250, but includes idle time 251. In one example, regardless of whether NCG 242 includes a DBD FPG 250, duration $t_{NCG}$ of each NCG 242 of the series 240 is the same.

Figure 6:
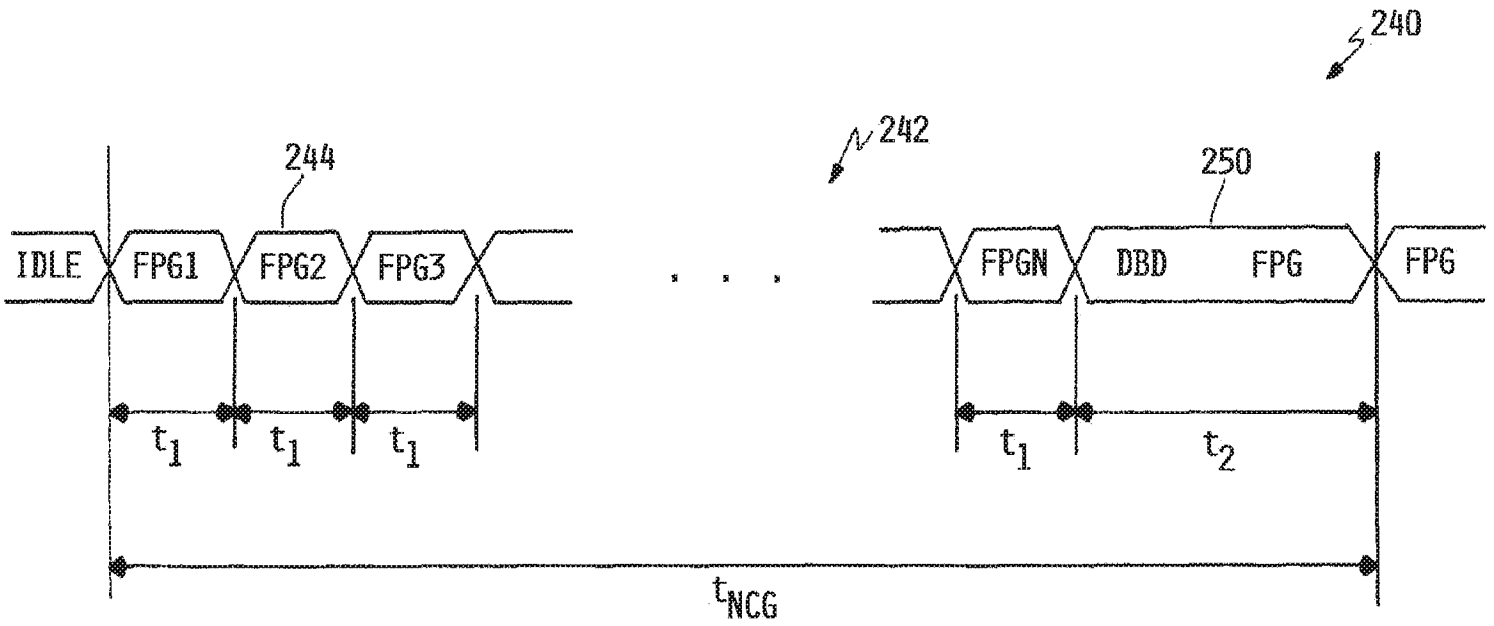
FIG. 6 is a block diagram illustrating generally an example of a nozzle column data group, according to one example.

In one example, with reference to FIGS. 6 and 7, for example, when a DBD operation is to be performed on one or more selected ejection chambers 150 of fluid ejection device 114, electronic controller 110 (or other controller) inserts a DBD FPG 250 in a suitable NCG 242, wherein DBD FPG 250 instructs primitive drive and logic circuitry 190 to perform DBD operations on identified nozzles as part of ongoing fluid ejection operations in accordance with the series of NPGs 240. By including DBD FPGs 250 in a series of NPGs 240, in accordance with the present disclosure, where each DBD FPG initiates performance of DBD measurements in one or more ejection chambers 150, the integrity of all ejection chambers 150 can be assessed over several NCGs during a print job, thereby greatly lessening or eliminating reductions in throughput of fluid ejection device 114 and printing system 100 otherwise caused by conventional DBD operations.

Returning to FIG. 5, in operation, input logic 192 of fluid ejection device 114 receives nozzle ejection data 256 in the form of a series of nozzle column data groups (NCGs) 240, such as from electronic controller 110 (see FIG. 2, for example). For each FPG 244, input logic 192 checks header 252 for the value of DBD enable bits 262. In a first example scenario, when DBD enable bits 262 have a disable value, input logic 192 deems FPG 244 to not be a DBD FPG 250 and, as a result, does not pass DBD operations data 260, including DBD enable bits 262, to DBD controller 200.

In such case, address data 258 is provided to address encoder 196, which encodes the corresponding address onto address bus 206, and data buffer 194 receives and places each of the data bits 264 from data portion 256 of FPG 244 onto its corresponding data line 204, where, in the case of fluid ejection device 114 being an inkjet printhead, the print data on data lines 204 represents characters, symbols, and/or other graphics or images to be printed, such as onto a print media, for example.

The encoded address on address bus 206 is provided to each address encoder 230-1 to 230-N of each primitive P1 to PM, with each of the address decoders corresponding to the address encoded on address bus 206 providing an active output to corresponding AND-gates 232 and 234. For example, if the encoded address from FPG 244 placed on address bus 206 represents address A1, address decoders 230-1 of each primitive P1 to PM will provide an active output to corresponding AND-gates 232-1 and 234-1.

AND-gates 232-1 to 232-N of each primitive P1 to PM receive outputs from corresponding address decoders 230-1 to 230-N, from the corresponding one of the data lines D1 to DM, and from fire pulse line 208. If the corresponding address decoder is providing an active output, if print data is present on the corresponding data line (e.g. a "1"), and the fire pulse on fire pulse line 208 is active, the output of the AND-gate will activate its output and close the corresponding switch 220, thereby energizing the firing resistor 160 to vaporize fluid in ejection chamber 150 and eject fluid from the associated nozzle 16. Continuing with the above illustrative example, with address Al encoded on address bus 206, the outputs of address decoders 230-1 of each primitive P1 to PM will be activated so that if print data is present on the corresponding data line 206, AND-gates 232-1 of each primitive P1 to PM will close the corresponding switch 220-1 when the fire pulse is active, thereby causing energizing the corresponding firing resistor 160-1 to eject fluid from the nozzle 16 of the corresponding fluid chamber 150.

In the first example scenario, since FPG 244 is not a DBD FPG 256, even though output of address decoders 230-1 is active, and even though print data might be present on the corresponding data line 204, the output of AND-gate 234-1 of each primitive P1 to PM will not be active because the DBD enable line is not active. As a result, FET 224-1 controlling DBD sense plate 164-1 of ejection chamber 150 corresponding to firing resistor 160-1 will not be closed so that a DBD sense operation will not be performed for the fluid chamber.

In a second example scenario, where DBD enable bits 262 of a received FPG 244 have an enable value, upon checking the value of DBD enable bits 262 in header 252, input logic 192 deems the FPG 244 to be a DBD FPG 250, and passes DBD operations data 260 to DBD controller 200. Again, address data 250 is provided to address encoder 196, which encodes the corresponding address onto address bus 206, and data buffer 194 receives and places each of the data bits 264 from data portion 256 of DBD FPG 250 onto its corresponding data line 204. Each address encoder 230-1 to 230-N of each primitive P1 to PM receives the encoded address, with each of the address encoders corresponding to the address encoded on address bus 206 providing an active output to corresponding AND-gates 232 and 234. For example, if the encoded address from DBD FPG 250 placed on address bus 206 represents address A1, address decoders 2301-1 of each primitive P1 to PM provide an active output to corresponding AND-gates 232-1 and 234-1.

Continuing with the above example, with the outputs of address decoders 230-1 of each primitive P1 to PM being activated, if DBD ejection data 264 is present on the corresponding data line 204 and fire pulse 208 is active, the outputs of AND-gates 232-1 of each primitive P1 to PM will be active, thereby closing the corresponding switch 220-1 and energizing the corresponding firing resistor 160-1 to vaporize fluid in ejection chamber 150 and form a drive bubble 170 to eject an fluid drop 159 from the associated nozzle 16.

In this second example scenario, with the FPG having been deemed to be a DBD FPG 250, DBD controller 200, based on delay information included in DBD operations data 260, activates DBD enable line 210 at a predetermined time after activation of the firing resistors 160-1 (e.g.; at a point after drive bubble 170 is expected to have been formed or to have already have collapsed, for instance). With the outputs of address decoders 230-1 of each primitive P1 to PM being activated, and with the DBD enable line 210 being activated, outputs of AND-gates 234-1 of each primitive P1 to PM will be activated if DBD ejection data 264 is present on the corresponding data line 204 (e.g., has a value of "1"), thereby closing DBD switch 224-1 and coupling DBD sense plates 164-1 to the DBD sense line 212 corresponding to the particular primitive.

In view of the above, for each primitive P1 to PM for which the DBD ejection data bit 264 on the corresponding data line D1 to DM is set (e.g., has a value of "1"), the firing resistor 160-1 will have been energized to generate drive bubble 170 within the corresponding fluid chamber 150 to eject an fluid droplet 159 from the nozzle 16 thereof. At some point during the formation or collapse of the drive bubble 170, as based on the delay information included in DBD operations data 260, DBD sensor 202 of DBD controller 200 injects a sense current, is, into the corresponding DBD sense 212. DBD sensor 202 measures a resulting voltage level, $V_{DBD}$, on each of the active sense lines 212, and provides such voltage measurements to a controller, such as electronic controller 110, such as via a communication link 236. In one example, DBD controller 200 places analog voltage measurements on terminal or contacts sensed by an external controller, such as electronic controller 110. In one example, DBD controller 200 provides such voltage measurements in digital format. In one example, electronic controller 110 (or other controller) compares such voltage measurements to expected voltage measurements of known healthy nozzles to determine an operating condition of the fluid chamber 150 (e.g., healthy, blocked, partially blocked).

As a specific example, if address data 258 of DBD FPG 250 corresponds to address A1, and DBD ejection data bit 264 corresponding to primitive P1 is set (e.g., has a value of "1"), AND-gates 232-1 of primitive P1 will first close switch 220-1 to energize firing resistor 160-1 to form a drive bubble 170, and at a later time, DBD controller 200 will activate DBD enable line 210 such that AND-gate 234-1 of primitive P1 will close switch 224-1, thereby connecting DBD sense plate 164-1 to DBD sense line S1. DBD sensor 202 will impress a fixed sense current, is, on DBD sense line S1 which will flow through impedance path 168-1 in ejection chamber 150-1 to generate a resulting voltage, $V_{DBD}$, on DBD sense line S1 (see FIG. 3B).

In the example of FIG. 5, DBD controller 200 includes one sense line 212 for each primitive 180, illustrated as sense lines S1 to SM corresponding to primitives P1 to PM. Such implementation enables DBD operations to be concurrently performed on one ejection chamber 150 in each primitive 180. As such, in FIG. 5, DBD operations may be concurrently performed on M ejection chambers 150 (i.e., one in each of the M primitives 150) of column 178 of primitives P1 to PM. By successively cycling through primitive addresses A1 to AN (not necessarily in numerical order), DBD operations can ultimately be performed on all ejection chambers 150 of fluid ejection device 114 in groups of M ejection chambers at a time.

While illustrated in FIG. 5 as employing one sense line 212 per primitive 180, it is noted that more or fewer sense lines 212 can be employed. For instance, in one example, a single sense line 212 may be shared by all primitives P1 to PM. In such instance, a DBD operation may be performed on only one ejection chamber 150 at a time in column 178 of primitives P1 to PM. Additionally, in other examples, switches 224 may be implement in configurations other than a FET, such as an enable-able amplifier, for instance, the output of each being connected to a single sense line, wherein bases on primitive data, only the amplifier of one primitive would be driving the single sense line at a time. In another example, two sense lines 212 may be employed, with one sense line 212 being connected to even-numbered primitives 180 and the other sense line being connected to odd-numbered primitives 180, for instance.

With reference to FIGS. 7 and 8, according to the illustrated example, DBD FPG 250 includes address data 258 for a single address and ejection data 264 for each ejection chamber 150 at the identified address in each primitive P1 to PM. In one example, DBD FPG 250 may include address data 258 and ejection data 264 for performing DBD operations for more than one address (e.g. two addresses). In such case, DBD operations may be sequentially performed for each of the different addresses.

By adding an ejection address to a NCG in the form of a DBD FGP, in accordance with the present disclosure, DBD operations can be performed on a fluid chamber without affecting fluid ejection by the fluid chamber or servicing (e.g., recirculation pumping). As a result, adverse effects on throughput of the fluid ejection device otherwise resulting from performance of DBD operations is greatly reduced or eliminated relative to conventional processes where DBD operations are performed between ejection jobs.

Figure 9:
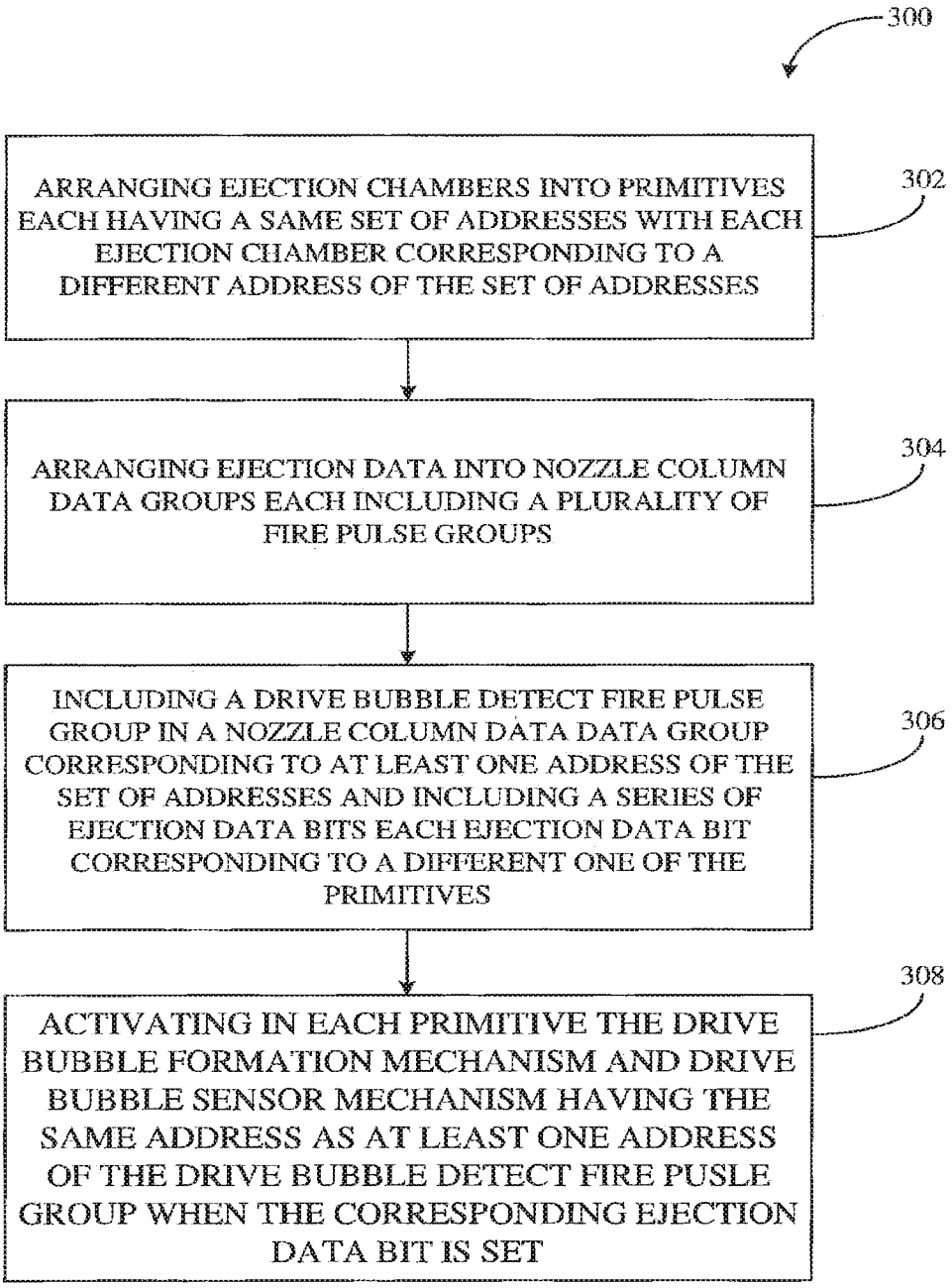
FIG. 9 is a flow diagram generally illustrating a method of operating a fluid ejection system, according to one example.

FIG. 9 is a flow diagram generally illustrating a method 300 of operating a fluid ejecting system, such as fluid ejection system 100 including a fluid ejection device, such as fluid ejection device 114 of FIGS. 4 and 5, according to one example of the present disclosure. At 302 method 300 includes arranging a plurality of ejection chambers into a plurality of primitives with each primitive receiving a same set of addresses, such as ejection chambers 150 being organized into primitives 180 and having a same set of addresses 182 as shown in FIGS. 4, 5, and 9. Each ejection chamber of a primitive includes a drive bubble formation mechanism and a drive bubble sensor mechanism, with each ejection chamber corresponding to a different address of the set of addresses, such as ejection chambers 150 each including a drive bubble formation mechanism 160 and a drive bubble sensor mechanism 164 as illustrated by FIGS. 4, 5, and 9.

At 304, method 300 includes arranging ejection data into a series of nozzle column data groups, with each nozzle column data group including a plurality of fire pulse groups, such as controller 110 arranging ejection data into a series of nozzle column data groups 240, with each nozzle column data group 242 including a plurality of fire pulse groups, as illustrated by FIG. 6.

At 306, method 300 includes adding a DBD FPG in a nozzle column data group, the DBD FPG corresponding to at least one address of the set of addresses and including a series of ejection data bits, each ejection data bit corresponding to a different one of the primitives, such as controller 110 including DBD FPG 250 in NCG 242 of the series of NCGs 240, with DBD FGP 250 including a series of ejection data bits 264 corresponding to a different one of the primitives P1 to PM, as illustrated by FIGS. 6 and 7.

At 308, method 300 includes activating in each primitive, in response to the drive bubble detect fire pulse group, the drive bubble formation mechanism and the drive bubble sensor mechanism of the ejection chamber having the same address as the at least one address to which drive bubble detect fire pulse group corresponds to form a drive bubble and to perform a drive bubble sensing measurement when the corresponding ejection data bit is set, such as primitive drive and control logic 190 of fluid ejection device 114 of FIG. 5 activating drive bubble formation mechanisms 160 and drive bubble sensor mechanisms 164 of each primitive 180 having an address (e.g., addresses A1 to AN) corresponding to the at least one address of the drive bubble detect fire pulse group received at 240 (e.g., received from printing system controller 110).

Although specific examples have been illustrated and described herein, a variety of alternate and/or equivalent implementations may be substituted for the specific examples shown and described without departing from the scope of the present disclosure. This application is intended to cover any adaptations or variations of the specific examples discussed herein. Therefore, it is intended that this disclosure be limited only by the claims and the equivalents thereof.

The invention claimed is:

1. A fluid ejection device comprising:

a number of primitives having a number of ejection chambers;

mechanisms for drive bubble formation and drive bubble detection (DBD) associated with the number of ejection chambers;

an input logic to receive signals indicative of drive bubble formation and DBD in a single stream from an external controller; and the fluid ejection device to cause drive bubble formation for a subset of ejection chambers concurrently with DBD of one or more of the number of ejection chambers based on signals received via the single stream.

2. The fluid ejection device of claim 1 further comprising nozzles associated with the number of ejection chambers and wherein the to be received signals indicative of drive bubble formation and DBD are to cause ejection of printing fluid via the nozzles.

3. The fluid ejection device of claim 2, wherein the mechanisms for DBD are to monitor formation and collapse of drive bubbles responsive to the to be received signals indicative of drive bubble formation and DBD.

4. The fluid ejection device of claim 3, wherein monitoring of drive bubble formation and collapse is to be based on a voltage measurement at the mechanisms for DBD.

5. The fluid ejection device of claim 4, wherein the voltage measurement is to be transmitted to the external controller.

6. The fluid ejection device of claim 1 further comprising an activation logic to receive signals indicative of firing resistor activation from the input logic, the to be received signals indicative of firing resistor activation to be based on the to be received signals indicative of drive bubble formation and DBD.

7. The fluid ejection device of claim 6, wherein the to be received signals indicative of firing resistor activation correspond to addresses for the number of ejection chambers.

8. The fluid ejection device of claim 7, wherein each address of the addresses is indicative of a particular primitive of the number of primitives and a particular ejection chamber within the number of ejection chambers.

9. The fluid ejection device of claim 8, wherein the to be received signals indicative of drive bubble formation and DBD in the single stream include a nozzle column data group (NCG) having a number of fire pulse groups (FPGs), wherein each FPG includes fire data for an ejection chamber of a primitive based on an address for the ejection chamber and the primitive.

10. The fluid ejection device of claim 9, wherein the to be received signals indicative of drive bubble formation and DBD in the single stream also include a value corresponding to firing resistor activation.

11. The fluid ejection device of claim 10, wherein the to be received signals indicative of drive bubble formation and DBD in the single stream also include an address and a value corresponding to a DBD operation.

12. The fluid ejection device of claim 11, wherein the to be received signals indicative of drive bubble formation and DBD in the single stream also include signals indicative of DBD parameters including measurement delay, threshold values, sense current levels, voltage levels, or a combination thereof.

13. A method of performing drive bubble formation concurrently with drive bubble detection (DBD) by a fluid ejection device, the method comprising:

receiving signals indicative of print job drive bubble formation and DBD in a single stream via a connection to an external electronic controller; and responsive to the received signals indicative of print job drive bubble formation and DBD, causing activation of firing resistors of ejection chambers to cause ejection of printing fluid for a print job concurrently with DBD operations without pausing the print job.

14. The method of claim 13 further comprising:

receiving the signals indicative of print job drive bubble formation and DBD at an input logic of the fluid ejection device;

determining ejection chambers for which firing resistors are to be activated;

determining ejection chambers for which DBD operation is to be performed; and causing transmission of signals to the ejection chambers for which firing resistors are to be activated and of signals to the ejection chambers for which DBD operation is to be performed.

15. The method of claim 13 further comprising transmitting to the external electronic controller signals indicative of nozzle condition responsive to the signals indicative of print job drive bubble formation and DBD.

16. The method of claim 15 further comprising receiving signals from the external electronic controller indicative of servicing procedures in response to the transmitted signals indicative of nozzle condition.

17. The method of claim 15 further comprising receiving signals from the external electronic controller indicative of adjusted firing patterns in response to the transmitted signals indicative of nozzle condition.

18. The method of claim 13, wherein the receiving of the signals indicative of print job drive bubble formation and DBD comprises reception of a first nozzle column data group (NCG) comprising a number of fire pulse groups (FPGs) and a DBD FPG.

19. The method of claim 18, wherein the receiving of the signals indicative of print job drive bubble formation and DBD comprises reception of a second NCG comprising a number of FPGs and another DBD FPG.

20. A printing system comprising:

an electronic controller to:

cause transmission of a print job to a fluid ejection assembly having a plurality of fluid chambers, the print job including, in a single data stream, fluid ejection data to initiate drive bubble formation concurrently with data to initiate drive bubble detection (DBD) operation of a number of fluid chambers of the fluid ejection assembly; and receive, responsive to the transmission of the print job, signals indicative of condition of the number of fluid chambers based on the DBD operations occurring without interrupting the print job.

* * * * *